US005435221A

United States Patent [19]

Yamauchi

[11] Patent Number: 5,435,221

[45] Date of Patent: Jul. 25, 1995

[54] FLUTE MOUTHPIECE

[76] Inventor: Genhichi Yamauchi, 95, Satokomaki Yamakata, Kisogawacho, Haguri-gun, Aichi-ken, Japan

[21] Appl. No.: 291,502

[22] Filed: Aug. 17, 1994

[30] Foreign Application Priority Data

Nov. 1, 1993 [JP] Japan ..... 5-297337

[51] Int. Cl.[6] ..... G10D 7/02

[52] U.S. Cl. ..... 84/384

[58] Field of Search ..... 84/384, 380 R, 383 R, 84/398

[56] References Cited

U.S. PATENT DOCUMENTS 4,970,931 11/1990 Calbreath ..... 84/384

5,261,308 11/1993 Yamauchi et al. ..... 84/384

*Primary Examiner*—Michael L. Gellner

*Assistant Examiner*—Cassandra C. Spyrou

*Attorney, Agent, or Firm*—Oliff & Berridge

[57] ABSTRACT

In a flute mouthpiece in which the inner surface of a hole on this side, on which the lip is to be placed, is made to extend downward into a head pipe to form, on the inner wall of said head pipe, a projecting tongue, the lower surface of which is formed by a concave curved surface and in which the interior space of said head pipe is divided into two parts including an acoustic space and a fluid space, a concave portion having a cross-sectional area equal to that of said projecting tongue is provided on the lower portion of said inner surface of said head pipe which is continuous to said concave curved surface, so that the straight travel property of a sound is enhanced by an interference of a sound wave and the efficiency of exhalation converting its energy to a sound is enhanced, thereby making it possible to obtain a clear, vigorous, and rich quality sound. In addition, since the high-pitched tones of the scale of the flute cannot possibly be not true and a sound cannot possibly be confined inside, a sufficiently clear, vigorous, rich, and loud quality sound can be obtained.

1 Claim, 2 Drawing Sheets

FLUTE MOUTHPIECE

BACKGROUND OF THE INVENTION

1. Field of the Invention

The present invention relates to a flute mouthpiece, and, more particularly, to a flute mouth-piece in which a sound cannot possibly be confined inside or become unclear, and with which a clear, vigorous, rich, and loud quality sound can be produced at all times.

2. Description of the Prior Art

The present inventor has already studied and invented a flute mouthpiece designed to produce a rich, good quality sound by dividing the interior space of a pipe into two parts, including an acoustic space and a fluid space, by forming a projecting tongue.

More specifically, in the flute mouthpiece 2*a* shown in FIG. 1, in which a continuous inner surface extending from an edge 4*a* through the inner surface of a hole 3*a* to the upper portion of an inner surface 5*a* of a head pipe 1*a* is formed to be a streamlined surface 6*a* to produce a laminar flow free of any turbulence. The inner surface of the hole 3*a* on this side, on which the lip is to be placed, is made to extend downward into the head pipe 1*a* to form, on the inner wall of the head pipe 1*a*, a projecting tongue 11*a*, the lower surface of which is formed by a concave curved surface 12*a*, so that the interior space of the head pipe 1*a* is divided into two parts including an acoustic space A and a fluid space B.

An exhalation 7*a* sent through the gap between the lips is trained against the edge 4*a* and is therefore divided into halves as indicated by an inside vector 8*a* and an outside vector 9*a*. The air stream indicated by the inside vector 8*a* then flows along the edge 4*a*, the streamlined surface 6*a*, and the inner surface 5*a* of the head pipe 1*a* in this sequence. It is to be noted that a sound is produced when air blown against the edge 4*a* vibrates vertically in the acoustic space A. That is, the streamline indicated by the inside vector 8*a* becomes a laminar flow without forming any turbulence and, moreover, this flow swirls along the concave curved surface 12*a* of the projecting tongue 11*a* within the head pipe 1*a* and becomes a helical flow which, in turn, moves forward within the head pipe 1*a*. Due to this helical flow, an inward inflow vector 10*a* from the hole 3*a* toward the inner part acts to cause a type of vortex absorption, and this inflow vector 10*a* flows into a region of the fluid space B located below the projecting tongue 10*a* and has the function of joining the helical flow of the inside vector 8*a*.

In the case of the above-described flute mouthpiece, however, since the inner surface of the hole 3*a* on this side is made to extend downward into the head pipe 1*a* to form, on the inner wall of the head pipe 1*a*, the projecting tongue 11*a*, the lower surface of which is formed by the concave curved surface 12*a*, the interior space of the head pipe 1*a* is narrowed by the projecting tongue 11*a*. Since the fluid space B in particular is narrowed, the function of joining the inflow vector 10*a* with the helical flow of the inside vector 8*a* within the fluid space B is not sufficient and the vortex effect to which resistance to exhalation is reduced deteriorates, preventing a clear, vigorous, and rich quality sound from being obtained satisfactorily.

To cope with this, the present inventor has studied and invented another flute mouthpiece capable of eliminating the above-described problems.

More particularly, in the flute mouthpiece in FIG. 2, a projecting tongue 11*a* is provided such that, where the inner surface of a hole 3*a* on this side, on which the lip is to be placed, meets the inner surface of a head pipe 1*a*, a bulgy rounded concave surface 12*a* is formed so as to bulge outward from the head pipe 1*a*, and the interior space of the pipe head 1*a* is divided into two parts including an acoustic space A and a fluid space B.

In the case of the above-described flute mouthpiece, since the fluid space is expanded outwardly to become a bulging enlarged space, a vortex effect resulting from the helical flow generated in the fluid space is great enough to obtain a sufficiently clear, vigorous, rich, and loud quality sound. However, it was found that, since the degree of taper of the undercut of the hole 3*a* of a mouthpiece 2*a* is excessively large, the high-pitched tones of the scale of the flute are not true and the highest pitched tone is not produced. It was also found that the straight travel property of a sound wave deteriorates, so that a sound is confined inside.

SUMMARY OF THE INVENTION

It is, accordingly, a principal object of the present invention to provide a flute mouthpiece in which high-pitched tones cannot possibly be not true and a sound cannot possibly be confined inside, and by means of which a sufficiently clear, vigorous, rich, and loud quality sound can be obtained.

The foregoing object is accomplished in accordance with the present invention by providing a flute mouthpiece in which a continuous inner surface extending from an edge through the inner surface of a hole to the upper portion of an inner surface of a head pipe is formed to be streamlined to make a laminar flow that is free of any turbulence, and the inner surface of the hole on the side, on which the lip is to be placed, is made to extend downward into the head pipe to form, on the inner wall of the head pipe, a projecting tongue, the lower surface of which is formed by a concave curved surface. A concave portion having a cross-sectional area equal to that of the projecting tongue is provided on the lower portion of the inner surface of the head pipe which is continuous along the concave curved surface.

BRIEF DESCRIPTION OF THE DRAWINGS

The drawbacks of a conventional flute mouthpiece and the features and advantages of a flute mouthpiece according to the present invention will be more clearly understood from the following description taken in conjunction with the accompanying drawings in which.

DESCRIPTION OF THE PREFERRED EMBODIMENTS

Figure 1:
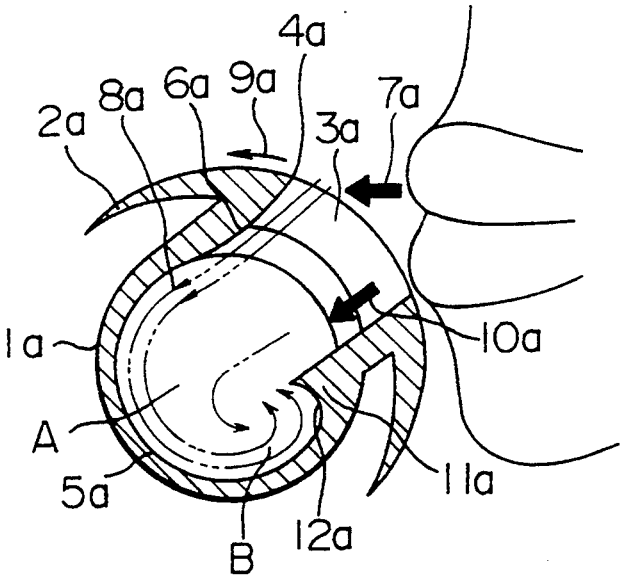
FIG. 1 PRIOR ART
FIG. 1 is a cross-sectional view showing a conventional flute mouthpiece.
Figure 2:
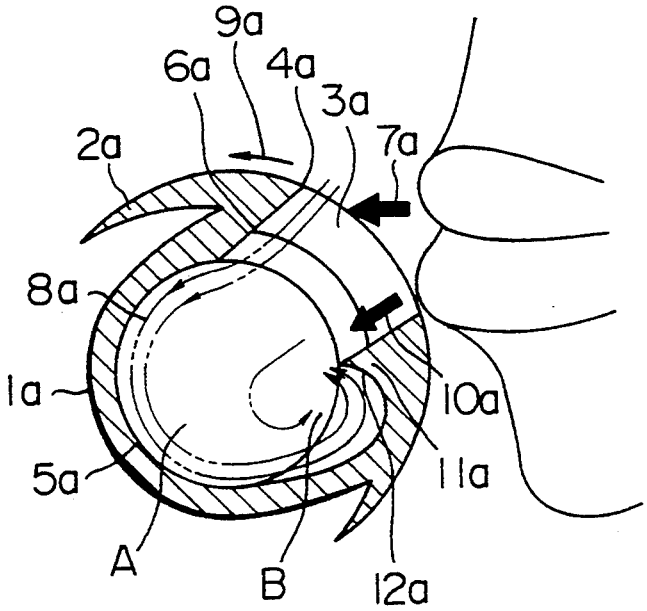
FIG. 2 PRIOR ART
FIG. 2 is a cross-sectional view showing another conventional flute mouthpiece.
Figure 3:
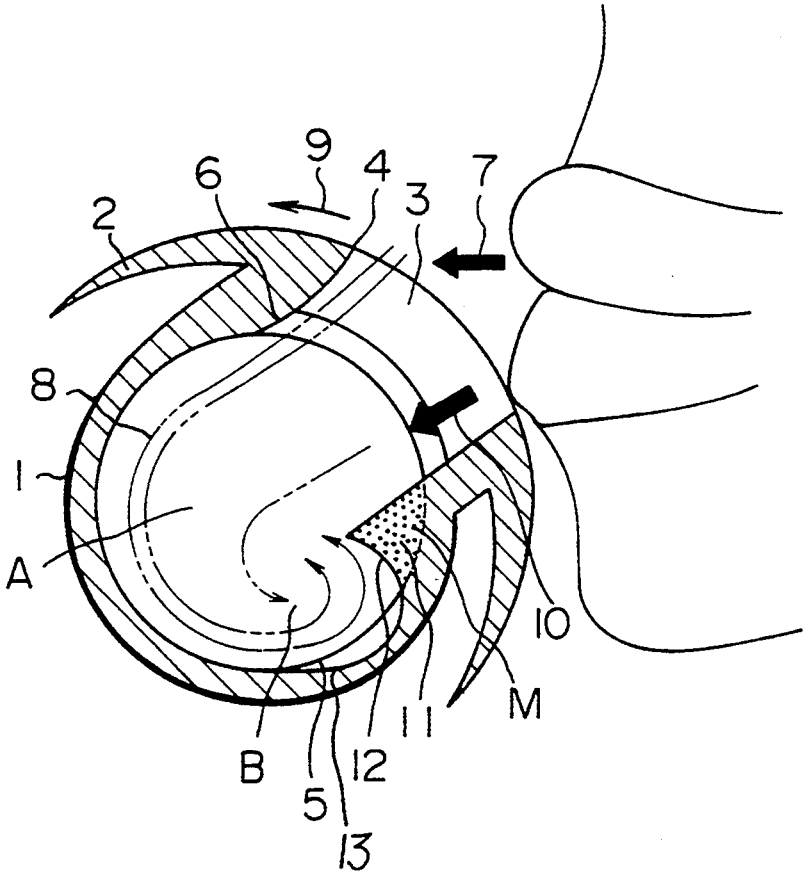
FIG. 3 is a cross-sectional view showing a flute mouthpiece according to an embodiment of the present invention.

An embodiment of the present invention will hereinafter be described in detail with reference to FIG. 3.

In the figure, reference numeral 2 denotes a mouthpiece formed on a flute. A continuous inner surface extending from an edge 4 through the inner surface of a hole 3 to the upper portion of an inner surface 5 of a head pipe 1 is formed to be streamlined 6 to produce a laminar flow free of any turbulence. In this mouthpiece 2, the inner surface of the hole 3 on this side, on which the lip is to be placed, is made to extend downward into the head pipe 1 to form, on the inner wall of the head pipe 1, a projecting tongue 11, the lower surface of which is formed by a concave curved surface 12, and the interior space of the head pipe 1 is divided into two parts including an acoustic space A and a fluid space B. In the present invention, a concave portion 13 is provided on the inner surface 5 continuous to the above-described concave curved surface 12. The concave portion 13 has a cross-sectional area equal to cross-sectional area M of the above-described projecting tongue 11. It is to be noted that an exhalation is denoted by reference numeral 7, an inside vector by reference numeral 8, an outside vector by reference number 9, and a turbulence vector by reference numeral 10.

Since the flute mouthpiece according to the present invention has the above-described structure, the generation of sound is not hindered by an irregular air flow and the straight travel property of a sound does not deteriorate due to interference by a sound wave. In addition, the efficiency of exhalation which converts its energy to a sound is enhanced, so that a clear, vigorous, and rich quality sound can be obtained. Further, the high-pitched tones of the flute scale cannot possibly be not true and therefore the highest pitched tone is not missing, and a sound cannot possibly be confined inside and therefore become unclear. Accordingly, a clear, vigorous, and rich quality sound can be obtained at all times.

While the subject invention has been described with relation to the preferred embodiment, various modifications and adaptations thereof will now be apparent to those skilled in the art. All such modifications and adaptations which fall within the scope of the appended claim are intended to be covered thereby.

What is claimed is:

1. A flute mouthpiece having a continuous inner surface for producing a laminar flow free from turbulence, the flute mouthpiece comprising:

a head pipe having a head pipe inner surface and an edge;

a hole in said head pipe having a hole inner surface extending from said edge to said head pipe inner surface, said hole inner surface and said head pipe inner surface forming said continuous inner surface of said flute mouthpiece, said continuous inner surface having a lip side for placement of a lip of a user;

a concave portion on the head pipe surface on said lip side, said concave portion having a concaved curve surface and a cross-sectional area thereof;

a tongue projecting from said head pipe inner surface on said lip side including a lower surface, said tongue having a cross-sectional area, said lower surface of said tongue being formed by said concaved curved surface of said concave portion, said cross-sectional area of said concave portion being equal to said cross-sectional area of said tongue.

* * * * *